US005332043A

United States Patent [19]

Ferguson

[11] Patent Number: 5,332,043

[45] Date of Patent: Jul. 26, 1994

[54] WELLHEAD CONNECTOR

[75] Inventor: Bobby L. Ferguson, Friendswood, Tex.

[73] Assignee: ABB Vetco Gray Inc., Houston, Tex.

[21] Appl. No.: 94,810

[22] Filed: Jul. 20, 1993

[51] Int. Cl.[5] ..... E21B 17/02; E21B 33/03

[52] U.S. Cl. ..... 166/379; 166/75.1; 166/85; 285/138; 285/322

[58] Field of Search ..... 166/85, 75.1, 96, 379, 166/348, 88; 285/138, 144, 322, 323

[56] References Cited

U.S. PATENT DOCUMENTS

| | | | |
|---|---|---|---|
| 2,291,143 | 7/1942 | Brown et al. | 166/75.1 X |
| 3,068,027 | 12/1962 | Lewis et al. | 285/144 |
| 3,090,640 | 5/1963 | Otteman et al. | 166/75.1 X |
| 4,239,266 | 12/1980 | Mynhier | 285/323 |
| 4,936,382 | 6/1990 | Thomas | 166/88 |
| 5,056,830 | 10/1991 | Reanx | 285/15 |
| 5,135,266 | 8/1992 | Bridges et al. | 285/144 |
| 5,205,356 | 4/1993 | Bridges et al. | 166/85 |

*Primary Examiner*—Hoang C. Dang
*Attorney, Agent, or Firm*—James E. Bradley

[57] ABSTRACT

A wellhead connector has a tubular head that lands over a well conduit, such as casing. The head has an annular recess. An annular housing is located in the recess. The housing has a slips bowl which carries gripping segments for gripping the casing. The gripping segments have exterior wedge surfaces which are engaged by radially extending lock pins. The lock pins extend through threaded holes in the head and through holes in the housing. The housing has an exterior cam surface. The lock pins may be removed from engagement with the gripping segments, the head picked up, and the lock pins reinserted into the holes for engaging the housing cam surface. Rotating the lock pins releases the segments from engagement with the casing.

16 Claims, 3 Drawing Sheets

WELLHEAD CONNECTOR

BACKGROUND OF THE INVENTION

1. Field of the Invention

This invention relates in general to connecting tubular members together, and in particular to an apparatus and method for connecting a starter head to surface casing of a well.

2. Description of the Prior Art

When drilling an oil or gas well, surface casing will be set. The upper end of the surface casing will often protrude above the surface. A starter head may be mounted to the upper end of the surface casing. Pressure equipment, such as valve spools, will be mounted to the starter head.

Starter heads are connected to casing by various techniques, such as welding, threading, hydraulic crimping, and mechanical slips. Hydraulic crimping requires expensive, specialized equipment. Welding is time consuming and may leak if not done properly. On offshore platforms, welding may be prohibited. Also, at times, the starter head will be a temporary head and will need to be removed at a later date.

SUMMARY OF THE INVENTION

In this invention, the tubular head has an annular recess that encircles the well conduit casing. An annular housing locates in the recess of the head. The housing carries gripping means, preferably slip segments. The segments will move between a retracted position and a gripping position, in gripping engagement with the casing.

The gripping segments have exterior wedge surfaces. The head and the housing have aligned holes which also align with the wedge surfaces of the gripping segments. Lock pins will insert through the holes into engagement with the wedge surfaces for moving the gripping segments to the gripping position.

A cam surface is formed on the exterior of the housing which supports the segments. The cam surface enables the housing to be forced downward relative to the gripping segments after the lock pins are removed, if it is desired to remove the starter head. After the lock pins have been removed from engagement with the gripping segments, the starter head is picked up a short distance to align the holes in the starter head with the cam surface. The same lock pins then are reinserted to engage the cam surface to wedge the housing downward.

DETAILED DESCRIPTION OF THE INVENTION

Figure 1:
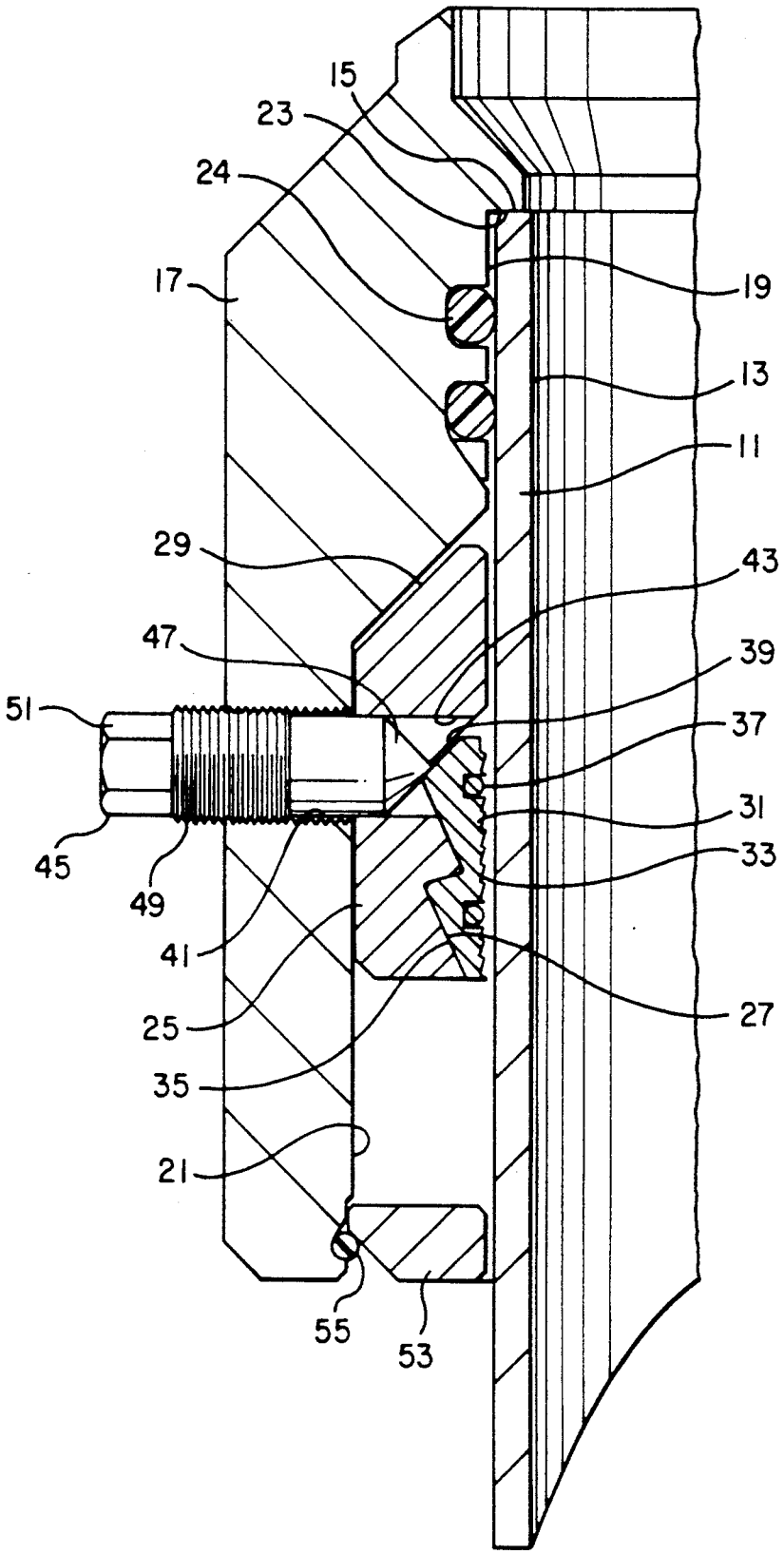
FIG. 1 is a quarter sectional view of a wellhead connector constructed in accordance with this invention, and shown on a wellhead but prior to the set position.

Referring to FIG. 1, the well will have an upward extending conduit or casing 11. Casing 11 has a bore 13 with a longitudinal axis. Casing 11 will be cut at its upper end, leaving a circular rim 15.

A starter head 17 is shown placed over casing 11. Starter head 17 is a tubular member which will support additional equipment (not shown) on its upper end, such as valve spools. Head 17 has an axial bore with a reduced diameter section 19 of slightly larger diameter than the outer diameter of casing 11. An annular recess 21 is located in the axial bore below reduced diameter section 19. Recess 21 has a larger diameter than reduced diameter section 19, and extends to the lower end of head 17. A shoulder 23 locates at the upper end of reduced diameter bore 19. Shoulder 23 lands on top of rim 15. Seals 24, shown to be elastomeric, are located in reduced diameter bore section 19 for sealing against casing 13.

A housing 25 is carried inside recess 21. Housing 25 is a solid metal ring having two conical interior surfaces or bowls 27, one above the other. Conical surfaces 27 face upward and inward. Housing 25 also has an exterior upward and outward facing cam surface 29 on its upper end. Cam surface 29 is also a conical surface. Housing 25 has an inner diameter above conical surfaces 27 that is slightly greater than the outer diameter of casing 11. Housing 25 has an outer diameter that is slightly smaller than the inner diameter of recess 21. Head 17 is axially movable relative to housing 25.

A plurality of slips or gripping segments 31 are carried on the conical surfaces 27 of housing 25. Gripping segments 31 are spaced circumferentially around the conical surface 27, the assembly defining a gripping member. Each segment 31 has teeth 33 formed on the interior. Each segment 31 has conical exterior surfaces 35 which mate with and slide on conical surfaces 27 of housing 25. Conical surfaces 27 are angled to create a locking taper to prevent upward movement of segments 31 on conical surfaces 27 once they are in the gripping position.

Figure 2:
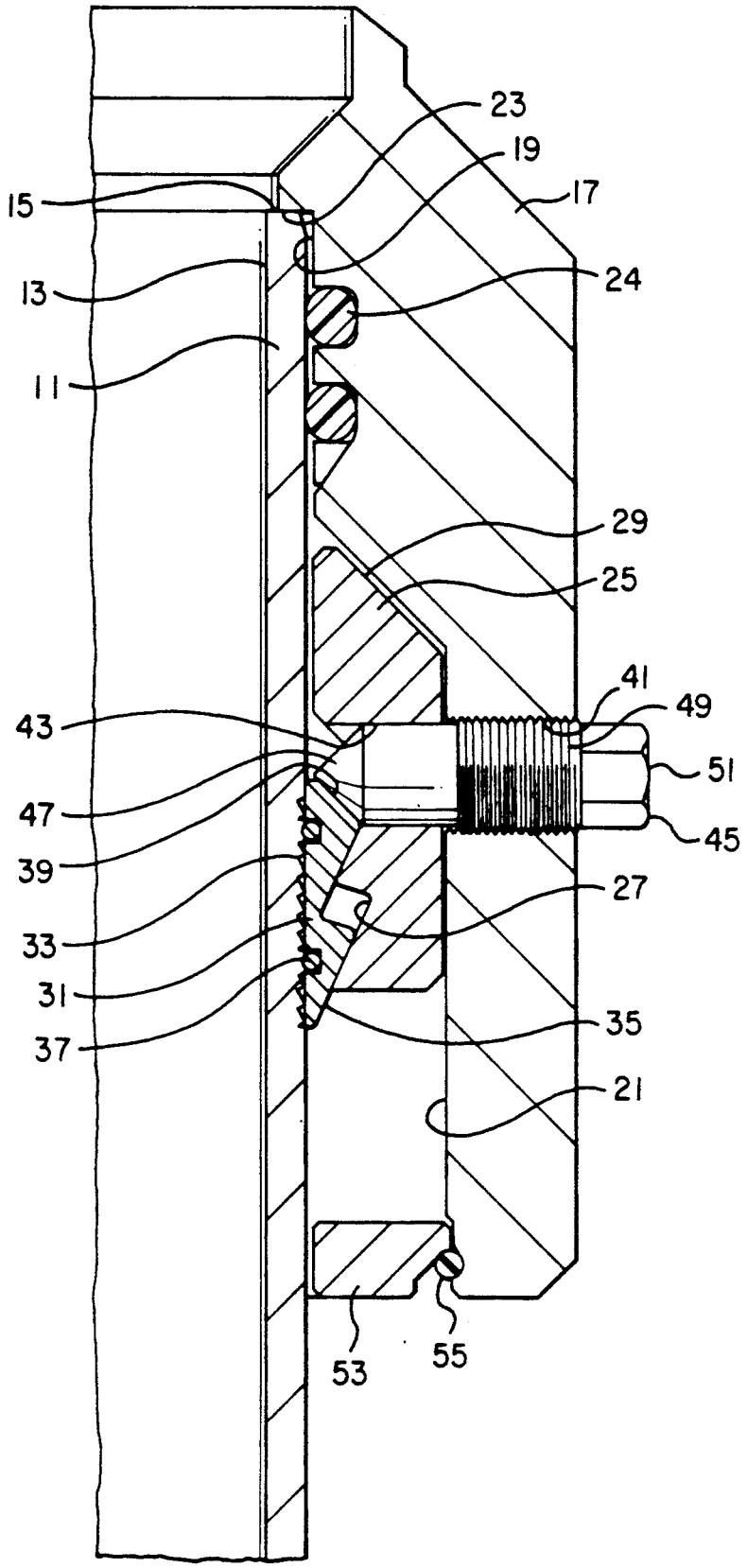
FIG. 2 is another quarter sectional view of the connector of FIG. 1, and showing the connector in the set position.

Segments 31 will move between a retracted position, shown in FIG. 1, to a gripping position, shown in FIG. 2, in gripping engagement with casing 11. A pair of split, annular resilient wires 37 locate within grooves formed in the inner sides of segments 31. Wires 37 cause the segments 31 to move downward in unison and also serve to retain the segments 31 in the retracted position shown in FIG. 1. Each gripping segment 31 has on its upper end, an exterior upward and outward facing wedge surface 39, which is also a conical surface. In the embodiment shown, there are eight of the segments 31.

Head 17 has a plurality of radially extending threaded holes 41. Each threaded hole 41 is located radially outward of one of the segments 31. In the embodiment shown, there are ten of the threaded holes 41. Housing 25 has a plurality of radially extending holes 43, one for each threaded hole 41. Housing holes 43 are not threaded and are positioned so that they will align with threaded holes 41 when segments 31 are in the retracted and gripping positions shown in FIGS. 1 and 2. Each hole 43 aligns with the wedge surface 39 of one of the gripping segments 31.

A lock pin 45 inserts into each pair of aligned holes 41, 43. Each lock pin 45 has a conical tip 47 that has an angle of taper the same as the taper of wedge surfaces 39 and cam surface 29. Each lock pin 45 has threads 49 for screwing into one of the threaded holes 41. A polygonal head 51 is on the outer end of each lock pin 45 for engagement by a wrench. When engaging threaded hole 41, the tip 47 will engage one of the wedge surfaces 39 when head 17 is in the position shown in FIGS. 1 and 2. Rotating lock pins 45 to the fully engaged position with threaded holes 41 will cause the segments 31 to move from the retracted position shown in FIG. 1 to the gripping position shown in FIG. 2.

A retainer ring or plate 53 mounts to the lower end of head 17. Retainer plate 53 is a solid metal ring that extends substantially from the inner diameter of recess 21 to the outer diameter of casing 11. A load ring or split wire 55 located in a groove in head 17 holds retainer ring 53 rigidly in place.

In operation, to install the connector, first casing 11 will be cut to form rim 15. Housing 25 will be assembled with segments 31 and placed in recess 21. Retainer plate 53 will be mounted to head 17. Wires 37 will retain gripping segments 31 in the retracted position. The head 17 will then be inserted over casing 11, with shoulder 23 landing on rim 15.

Lock pins 45 are then placed in holes 41 and rotated. Threads 49 will cause the lock pins 45 to advance inward. The conical tips 47 will rotate in sliding engagement with the conical wedge surfaces 39 on the gripping segments 31. This force overcomes the retaining force of wires 37 and causes tripping segments 31 to move downward, with teeth 33 biting into the exterior of casing 11, as shown in FIG. 2. Wires 37 cause the various segments 31 to move downward in unison with each other. Pins 45 do not need to be rotated in unison. However, all of the pins 45 will be eventually rotated into the position shown in FIG. 2 to insure proper loading. In the position shown in FIG. 2, gripping segments 31 prevent internal well pressure from moving head 17 upward.

If it is desired to remove the head 17 at a later time, the operator will unscrew all of the lock pins 45, withdrawing them from housing holes 43. Because of the locking taper of conical surfaces 27 and the gripping engagement of teeth 33 with casing 11, the segments 31 will not freely retract even after lock pins 45 are removed. The wires 37 do not have sufficient resilient strength to push the segments 31 back up to the retracted position once they have been placed in the set position.

Figure 3:
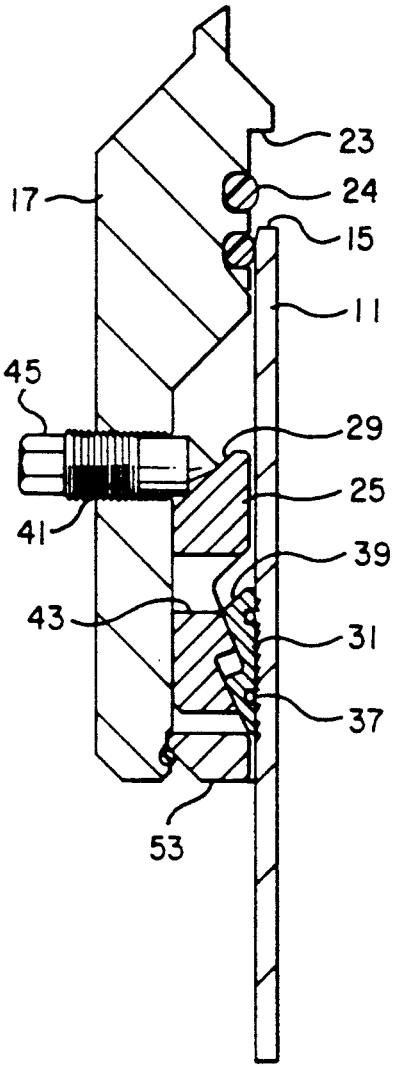
FIG. 3 is a reduced sectional view of the connector of FIG. 1, showing one step in a process of removing the head of the connector.

The operator will pick up head 17, which is then free to move upward relative to housing 25 a short distance. Shoulder 23 will move upward from rim 15. The upward travel is limited by the retainer plate 53 contacting the lower end of the segments 31. The operator then places at least some of the same lock pins 45 back into at least some of the threaded holes 41. The lock pins 45 at this point will engage the came surface 29 on housing 25, as shown in FIG. 3. The operator then rotates the lock pins 45, screwing them inward.

Figure 4:
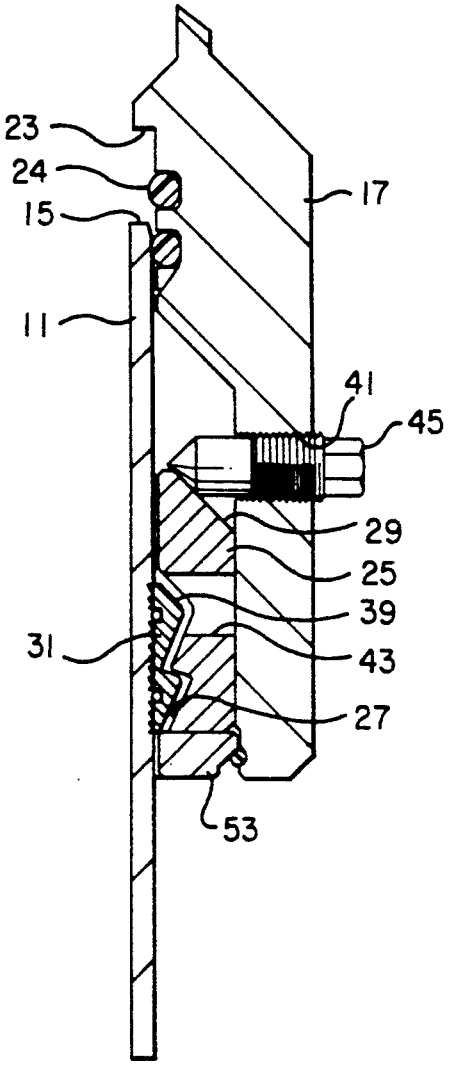
FIG. 4 is another reduced sectional view of the connector of FIG. 1, showing another step in removing the head.

A downward force will be exerted by tips 47 on cam surface 29 of housing 25 due to the inward rotation of the lock pins 45. This downward force occurs as a result of head 17 not yet being able to move upward because of the retainer ring 53 contacting the lower end of the segments 31, which are still locked to casing 11. The downward movement of housing 25 frees the segments 31, as shown in FIG. 4. At this point, the housing 25 conical surfaces 27 will not engage the segments 31 in a locking taper. The segments 31 are free to move outward to the retracted position. The operator may then lift the head 17 completely from the well conduit 11.

The invention has significant advantages. The connector is readily installed without using any special equipment. No welding is necessary. The slips are set mechanically by using wrenches. The head can be readily removed, also without any special equipment.

While the invention has been shown in only one of its forms, it should be apparent to those skilled in the art that it is not so limited, but is susceptible to various changes without departing from the scope of the invention.

I claim:

1. A connector for a tubular conduit, comprising in combination:

a tubular head having an annular recess;

the head adapted to be placed over the conduit with the recess encircling the conduit;

an annular housing located in the recess;

gripping means carried by the housing for movement relative to the housing between a retracted position and a gripping position in engagement with the conduit;

the gripping means having an exterior wedge surface;

the head and the housing having at least one set of holes which are alignable with each other and with the wedge surface of the gripping means;

lock pin means for extending through the set of holes when aligned with each other into removable engagement with the wedge surface for moving the gripping means to the gripping position;

a cam surface on an exterior surface of the housing; and means for enabling the cam surface to be engaged from the exterior of the head, for forcing the housing downward relative to the gripping means after the lock pin means has been removed from engagement with the wedge surface, to release the gripping means from engagement with the conduit for removal of the head.

2. The connector according to claim 1, wherein the gripping means comprises a plurality of segments spaced circumferentially around the housing.

3. The connector according to claim 1, wherein the hole in the head is threaded and the lock pin means comprises a threaded lock pin.

4. A connector for an upward extending wellhead conduit, comprising in combination:

a tubular head having a lower end and an annular recess extending upward from the lower end, the head adapted to be placed over the wellhead conduit with the recess encircling the wellhead conduit;

an annular housing located in the recess, the housing having an inner conical surface;

at least one gripping member having an inner gripping surface and carried on the conical surface of the housing for movement relative to the housing between an upper retracted position and a lower gripping position in engagement with the wellhead conduit;

the gripping member having an exterior upward and outward facing wedge surface;

the head and the housing having at least one set of holes which are alignable with each other and with the wedge surface of the gripping member;

at least one lock pin, the lock pin extending through the set of holes when aligned into removable engagement with the wedge surface for moving the gripping member to the gripping position; and an exterior upward and outward facing cam surface on the housing to enable the housing to be forced downward relative to the gripping member after the lock pin has been removed from engagement with the gripping member, to release the gripping member from engagement with the wellhead conduit for removal of the tubular head.

5. The connector according to claim 4, wherein once the lock pin is removed from engagement with the wedge surface, the head is movable upward to a releasing position in which the hole in the head aligns with the cam surface, enabling the lock pin to engage the cam surface to move the housing downward.

6. The connector according to claim 4, wherein the hole in the head is threaded.

7. The connector according to claim 4 wherein the head has an axis, and wherein the holes of the head and housing extend radially relative to the axis.

8. The connector according to claim 4 further comprising:

a retainer ring removably mounted to the lower end of the head at a lower end of the recess to retain the housing and gripping member in the recess.

9. The connector according to claim 4 wherein the gripping member comprises a plurality of gripping member segments, separated from each other and spaced circumferentially around the conical surface.

10. The connector according to claim 4 wherein the head has a reduced diameter bore above the recess and wherein the connector further comprises:

a seal located in the reduced diameter bore and sealing between the head and the wellhead conduit.

11. A connector for an upward extending wellhead conduit which has an upper rim, comprising in combination:

a tubular head having a downward facing shoulder, a reduced diameter bore extending downward from the shoulder, and an annular recess of larger diameter than the reduced diameter bore extending downward from the reduced diameter bore, the head adapted to be placed over the wellhead conduit with the shoulder landing on the rim, and the reduced diameter bore and the recess encircling the wellhead conduit;

a seal located in the reduced diameter bore for sealing to the wellhead conduit;

an annular housing located in the recess, the housing having an inner conical surface extending circumferentially around the housing;

a plurality of gripping member segments, each segment having an inner gripping surface and being carried on the conical surface of the housing for movement relative to the housing between an upper retracted position and a lower gripping position in engagement with the wellhead conduit;

each of the segments having an exterior upward and outward facing wedge surface;

a plurality of circumferentially spaced threaded holes in the head;

a plurality of circumferentially spaced housing holes in the housing, each of the threaded holes being alignable with one of the housing holes and with one of the wedge surfaces of the gripping member;

a plurality of threaded lock pins extending through the threaded holes and the housing holes into removable engagement with the wedge surfaces on the segments, for moving the segments to the gripping position when the lock pins are rotated; and an exterior upward and outward facing cam surface on the housing to allow the head to be removed from the wellhead conduit, if desired, by unscrewing the lock pins from engagement with the segments, lifting the head relative to the housing to align the threaded holes with the cam surfaces, then rotating at least some of the lock pins in the threaded holes into engagement with the cam surface to push the housing downward relative to the segments to release the segments from engagement with the wellhead conduit.

12. The connector according to claim 11 wherein the head has an axis, and wherein the threaded holes and the housing holes extend radially relative to the axis.

13. The connector according to claim 11 further comprising:

a retainer ring removably mounted to the head at a lower end of the recess to retain the housing and segments in the recess.

14. A method for securing and removing a tubular head from a tubular conduit, comprising in combination:

providing the head with an annular recess and at least one hole extending therethrough transverse to an axis of the head;

placing an annular housing in the recess, and providing the housing with at least one hole extending therethrough and with an external cam surface;

placing a gripping member in the housing and providing the gripping member with an external wedge surface;

placing the head over the conduit with the recess encircling the conduit;

aligning the hole of the head with the hole of the housing and with the wedge surface of the gripping member;

inserting a lock pin through the aligned holes into engagement with the wedge surface and moving the gripping member to a gripping position in engagement with the conduit; then, to remove the head, removing the lock pin from engagement with the wedge surface of the gripping member; then lifting the head relative to the housing until the hole in the head aligns with the cam surface on the housing; then inserting the lock pin through the hole in the head into engagement with the cam surface on the housing and forcing the housing downward relative to the gripping member, releasing the gripping member from engagement with the conduit; then removing the head from the conduit.

15. The method according to claim 14, wherein the step of providing the head with a hole further comprises providing the hole in the head with threads; and wherein the step of inserting the lock pin into engagement with the wedge surface comprises screwing the lock pin into the threads in the hole in the head.

16. The method according to claim 14 wherein the step of moving the gripping member to the gripping position comprises moving the gripping member down a conical surface provided in the housing.

* * * * *